US005870951A

United States Patent [19]

Fragstein

[11] Patent Number: 5,870,951

[45] Date of Patent: Feb. 16, 1999

[54] RUBBER BALER WITH EXTENDED SERVICE LIFE

[75] Inventor: Karl H. Fragstein, Orange, Tex.

[73] Assignee: Karltex Machine Inc., Orange, Tex.

[21] Appl. No.: 873,388

[22] Filed: Jun. 12, 1997

[51] Int. Cl.[6] ..... B30B 15/00; B30B 9/30

[52] U.S. Cl. ..... 100/245; 100/179; 100/249

[58] Field of Search ..... 100/179, 240, 100/245, 249

[56] References Cited

U.S. PATENT DOCUMENTS

| | | | |
|---|---|---|---|
| 3,940,217 | 2/1976 | McCarthy et al. . | |
| 3,949,035 | 4/1976 | Dunning et al. . | |
| 3,965,814 | 6/1976 | Manko | 100/245 |
| 3,977,315 | 8/1976 | Bettcher | 100/249 |
| 4,341,728 | 7/1982 | Robertson et al. . | |
| 4,406,603 | 9/1983 | Williams . | |
| 4,427,352 | 1/1984 | DeSantis et al. . | |
| 4,457,685 | 7/1984 | Huang et al. . | |
| 4,500,277 | 2/1985 | Bullock et al. . | |
| 4,678,425 | 7/1987 | Gibbemeyer . | |
| 4,936,206 | 6/1990 | Miles et al. | 100/188 R |
| 5,293,816 | 3/1994 | Musumeci, Sr. et al. | 100/245 |
| 5,461,975 | 10/1995 | Driggs | 100/245 |
| 5,629,033 | 5/1997 | Lienau | 100/249 |

OTHER PUBLICATIONS

CADCO® DELRIN Advertisement (May 1997).

*Primary Examiner*—Stephen F. Gerrity
*Attorney, Agent, or Firm*—Pravel, Hewitt & Kimball

[57] ABSTRACT

A improved service life baler press assembly including a number of novel press chamber and ram assembly components formed of a relatively hard material, such as a thermoplastic polymer (e.g., acetal resins) or any other suitable material having low static and dynamic coefficients of friction. Press chamber components according to the invention include press wall liners coupled to the press chamber walls. The press wall liners are manufactured of the thermoplastic polymer, and are disposed between the press walls and a ram head during periods of compression. The low static and dynamic coefficients of friction of the thermoplastic polymer material allow the ram head to move inside of the press chamber without damaging the walls of the press chamber. In addition, one embodiment of the present invention includes a ram head cover also composed of a thermoplastic polymer or other suitable material. The ram head cover reduces wear damage to the press wall liners. The surface area of a traditional ram head can be reduced to accept the ram head cover. The interaction between the various press chamber components reduces the contamination of rubber (or any other compressible material) by preventing metal cuttings from being formed during extended use. The disclosed press wall liners also feature a unique interlocking configuration that prevents rubber from migrating through the junctions of the wall liners.

17 Claims, 5 Drawing Sheets

RUBBER BALER WITH EXTENDED SERVICE LIFE

BACKGROUND OF THE INVENTION

1. Field of the Invention

The present invention relates to presses and baling equipment, and more particularly to a reduced-maintenance rubber baler utilizing thermoplastic or polymer materials having low static and dynamic coefficients of friction to improve structural components such as press chamber liners and platen or ram head covers.

2. Description of the Related Art

Baling machines come in many shapes and sizes, and are used to transform loose materials into solid blocks having a variety of uses. In typical baling machines, such as the type used to bale rubber products, rubber or other compressible material is fed into a press chamber by a conveyor belt or by screw conveyor. The material is then compressed in the press chamber by a hydraulic ram having a ram head or platen until a relatively solid block is formed. The block is then ejected and the process is repeated to form additional blocks.

Many rubber baling machines utilize steel for the press chamber walls, press chamber liners, ram head or platen covers, and wear strips about the press or mold chamber. Steel fragments resulting from grinding and wear on these steel components often results in metal contamination of the rubber product. This contamination sometimes causes the product to be rejected for uses requiring rubber of high purity in which even trace amounts of metal render the blocks useless. Further problems arise because the liner plates are often simply metal sheets butted up against one another. Rubber can migrate between the corners or junctions between these plates, causing misalignment between the press chamber and the hydraulic ram. Rubber extrusion between the steel components also results in product loss.

Attempts have been made to combat these problems. For example, the wear strips in many presses are comprised of materials other than steel in order to reduce frictional wear of steel press chamber walls due to movement of the ram head. Without frequent and time-consuming maintenance, however, the wear strips often become worn to the point of causing the press to become misaligned. In turn, misalignment frequently results in scoring of the steel press chamber walls and product contamination. The maintenance required for these prior art baling machines therefore results in less than desirable overall operating costs.

SUMMARY OF THE INVENTION

Briefly, a baler press assembly according to the present invention includes a number of novel press chamber and ram assembly components formed of a relatively hard material, such as a thermoplastic polymer (e.g., acetal resins) or any other suitable material having low static and dynamic coefficients of friction.

Press chamber components according to the invention include press wall liners coupled to the press chamber walls. The press wall liners are manufactured of the thermoplastic polymer or other suitable material, and are disposed between the press walls and the ram head during periods of compression. The low coefficients of friction of the thermoplastic polymer material allows the ram head to easily move inside of the press chamber without damage to the walls of the press chamber. In addition, one embodiment of the present invention includes a ram head cover also composed of the thermoplastic polymer or other suitable material. The ram head cover reduces wear damage to the press wall liners. The surface area of a traditional ram head can be reduced to accept the ram head cover. The interaction between the various press chamber components reduces the contamination of rubber (or any other compressible material) by preventing metal cuttings from being formed during extended use. The disclosed press wall liners also feature a unique interlocking configuration that prevents rubber from migrating through the junctions of the wall liners.

The improved components of the present invention can be scaled for use in a baler press assembly of any size. In addition to producing a higher-quality end product, it has been determined through lengthy experimentation that a baler press assembly incorporating these improved components has an improved service life, requiring much less maintenance than traditional baler presses.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE PREFERRED EMBODIMENT

Figure 1B:
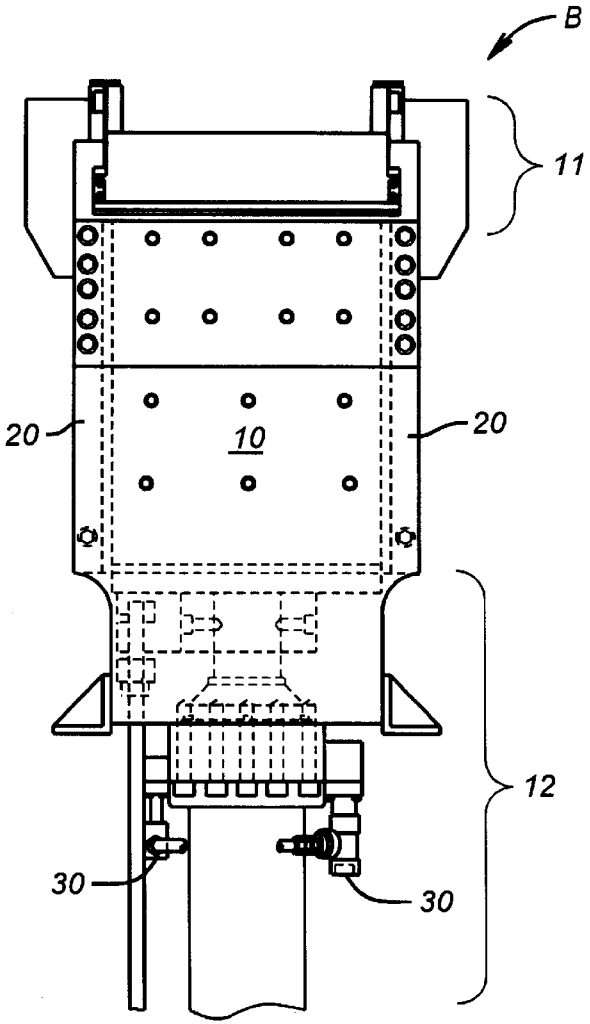
FIGS. 1A and 1B depict side and front views, respectively, of an upstroke baler press incorporating components according to the present invention.
Figure 1A:
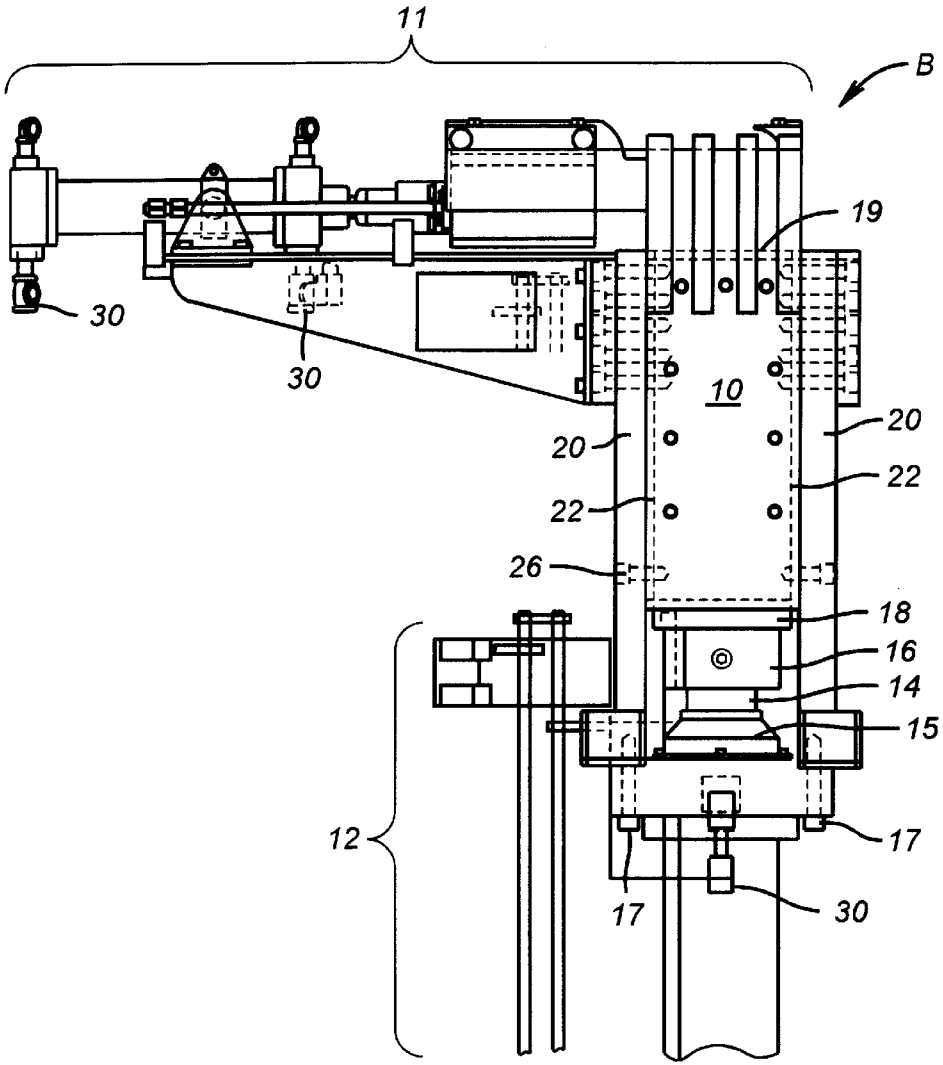

Turning now to the drawings, FIGS. 1A and 1B show side and front views, respectively, of an exemplary upstroke baler press assembly B incorporating novel components according to the present invention. The baler press assembly B is capable of producing high quality rubber bales and requires much less maintenance than prior balers. Only relevant portions of the baler press assembly B are shown; other portions are well known to those skilled in the art and are not discussed herein for sake of clarity.

In the disclosed embodiment of the invention, the baler press assembly B includes press chamber B formed of reduced wear components comprised of a thermoplastic polymer or other suitable material of the type described below. The baler press assembly B also includes a bale ejector assembly 11 and a ram assembly 12. During normal operation, rubber chips or other compressible materials are supplied to the press chamber B via a conveyor belt (not shown). The press chamber top liner 19 is then positioned over the press chamber B and the ram assembly 12 is activated.

The disclosed ram assembly 12 is comprised of a hydraulic rod 14 positioned within a rod housing and scraper 15. A ram head 16 is secured to the end of the hydraulic rod 14. In turn, a ram head cover 18 comprised of a thermoplastic polymer or other suitable material is secured to the ram head 16. The ram head 16 and ram head cover 18 are described below in greater detail in conjunction with FIGS. 2–3 and 7–8. The ram assembly 12 is coupled to the press walls 20 via socket cap screws 17.

Upon activation, hydraulic power is applied to the ram assembly 12 such that the hydraulic rod 14 travels in an upward direction, forcing the ram head 16 and ram head cover 18 into the press chamber 10. The baler press assembly B is powered by a hydraulic power unit (not shown). Hydraulic power from the power unit is supplied to the baler press assembly B at a number of power connection points 30. The compression force applied by the ram assembly 12 is of sufficient magnitude to form a solid bale of the compressible material contained in the press chamber 10. Following formation of the bale, the press chambertop liner 19 is repositioned and the bale is ejected by the bale ejector assembly 11. The entire process is then repeated to form additional bales.

For purposes of this specification, the term "thermoplastic polymer" is defined to encompass the DuPont materials Delrin® and Delrin AF® and any other materials having similar relevant properties. Delrin® is an acetal resin thermoplastic polymer (or acetal homopolymer) manufactured by the polymerization of formaldehyde. Delrin AF® contains high tensile strength fibers of Teflon® fluoroplastic resin. Similar wear resistant materials having low static and dynamic coefficients of friction (as compared to steel) and capable of being formed into or bonded to press wall liners and ram head covers are considered to fall within the scope of the term thermoplastic polymer as used in the claimed invention.

Referring more specifically to the press chamber 10, press walls 20 function to provide a rigid support capable of withstanding the necessary compression forces. Press wall liners 22 according to the invention are secured to the inside of the press walls 20 by means of socket cap screws 26. It is contemplated that many types of securing means could be used in place of the socket cap screws 26, and the precise manner in which the press wall liners 22 are secured to the press walls is not considered critical to the invention.

Figure 2:
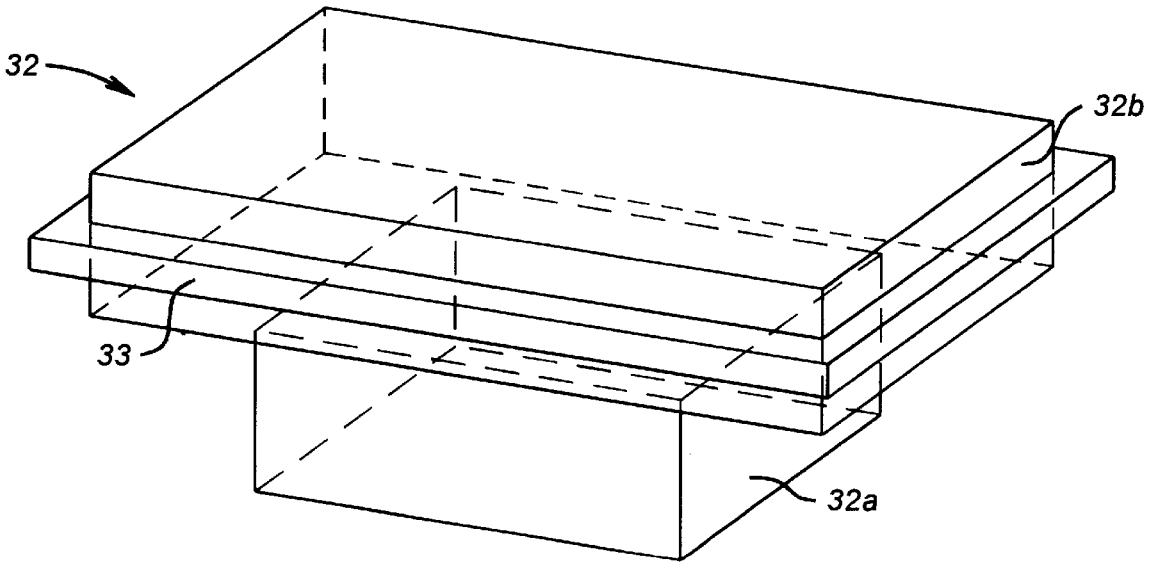
(PRIOR ART) FIG. 2
FIG. 2 is a perspective view of a prior art ram head.

Referring now to FIG. 2, a prior art metal ram head 32 is shown. This ram head 32 is comprised of a bottom portion 32*a* that connects to the hydraulic rod 14. A top portion 32*b* communicates hydraulic pressure to the press chamber 10. In prior baler press assemblies, frictional wear between the metal press walls 20 and the top portion 32*b* of the ram head 32 frequently results in costly maintenance and product contamination. A ring 33 comprised of Teflon® or the like has been used to the combat this problem. The ring 33 is situated in a groove along the outer circumference of top portion 32*b* of the ram head. The ring 33, however, may become worn to the point of causing the press to become misaligned. In turn, misalignment frequently results in scoring of the steel press chamber walls and product contamination.

Figure 3:
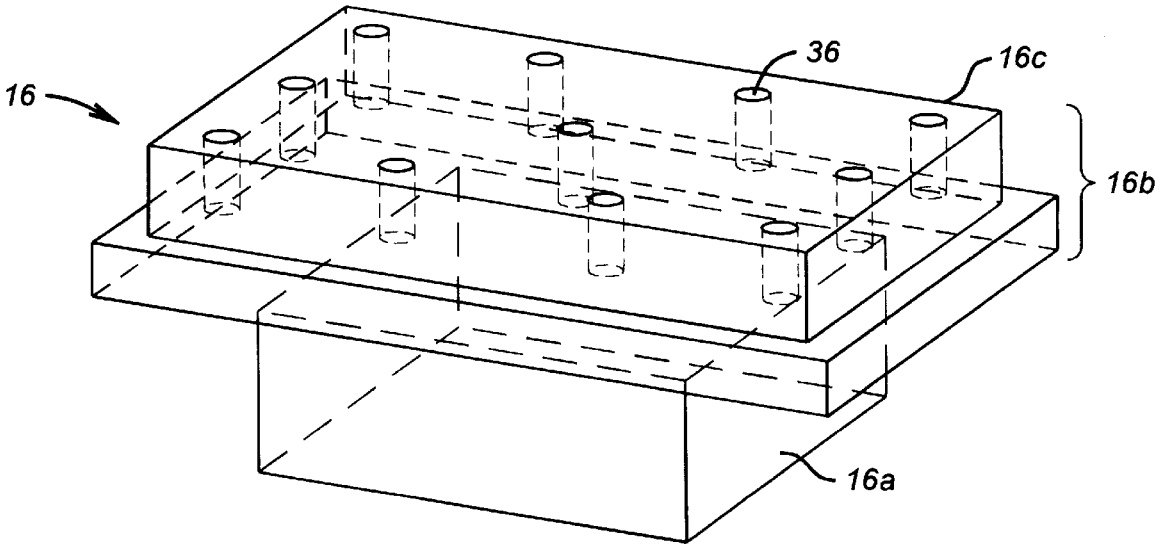
FIG. 3 shows a perspective view of a ram head according to the present invention.
Figure 7:
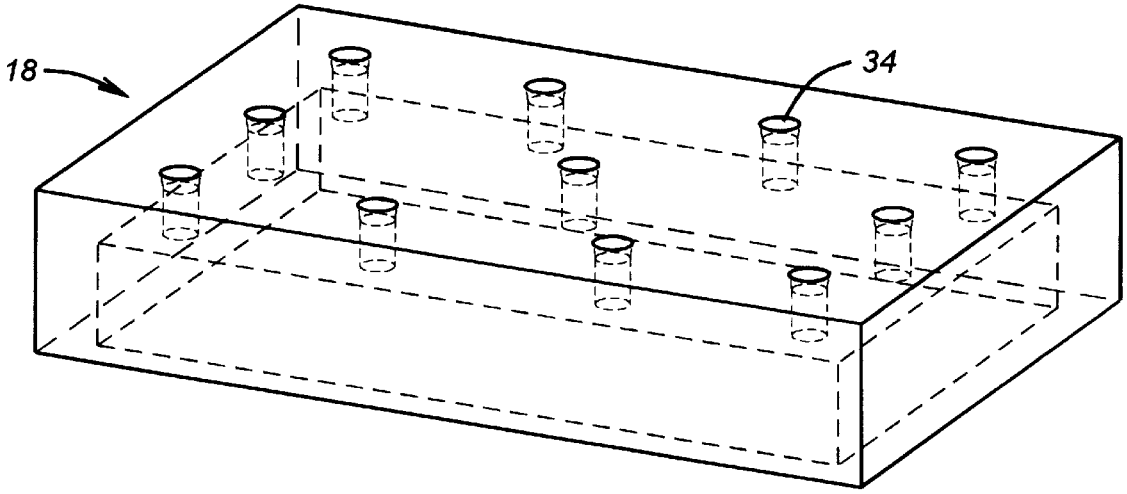
FIG. 7 is a perspective view of a ram head cover according to the present invention.
Figure 8:
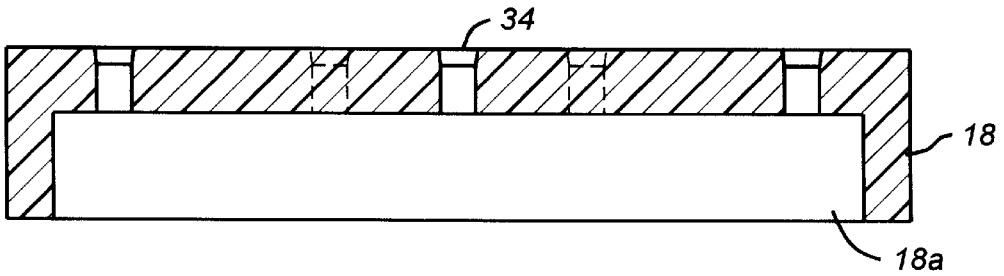
FIG. 8 is a cross sectional view of the ram head cover of FIG. 7.

Referring now to FIG. 3, a metal ram head 16 according to the present invention is shown. The ram head 16 includes a bottom portion 16*a* that connects to the hydraulic rod 14 and a top portion 16*b* for receiving the ram head cover 18 (FIGS. 7 and 8). In a departure from the prior art, the top portion 16*b* of the ram head 16 includes a reduced section 16*c* on which the ram head cover 18 is secured. The reduced section 16*c* includes a plurality of ram head bores 36 for receiving the mounting screws (not shown) used to attach the ram head cover 18. Preferably, no portion of the ram head 16 comes into frictional contact with the press wall liners 22 during a baling cycle.

Figure 4:
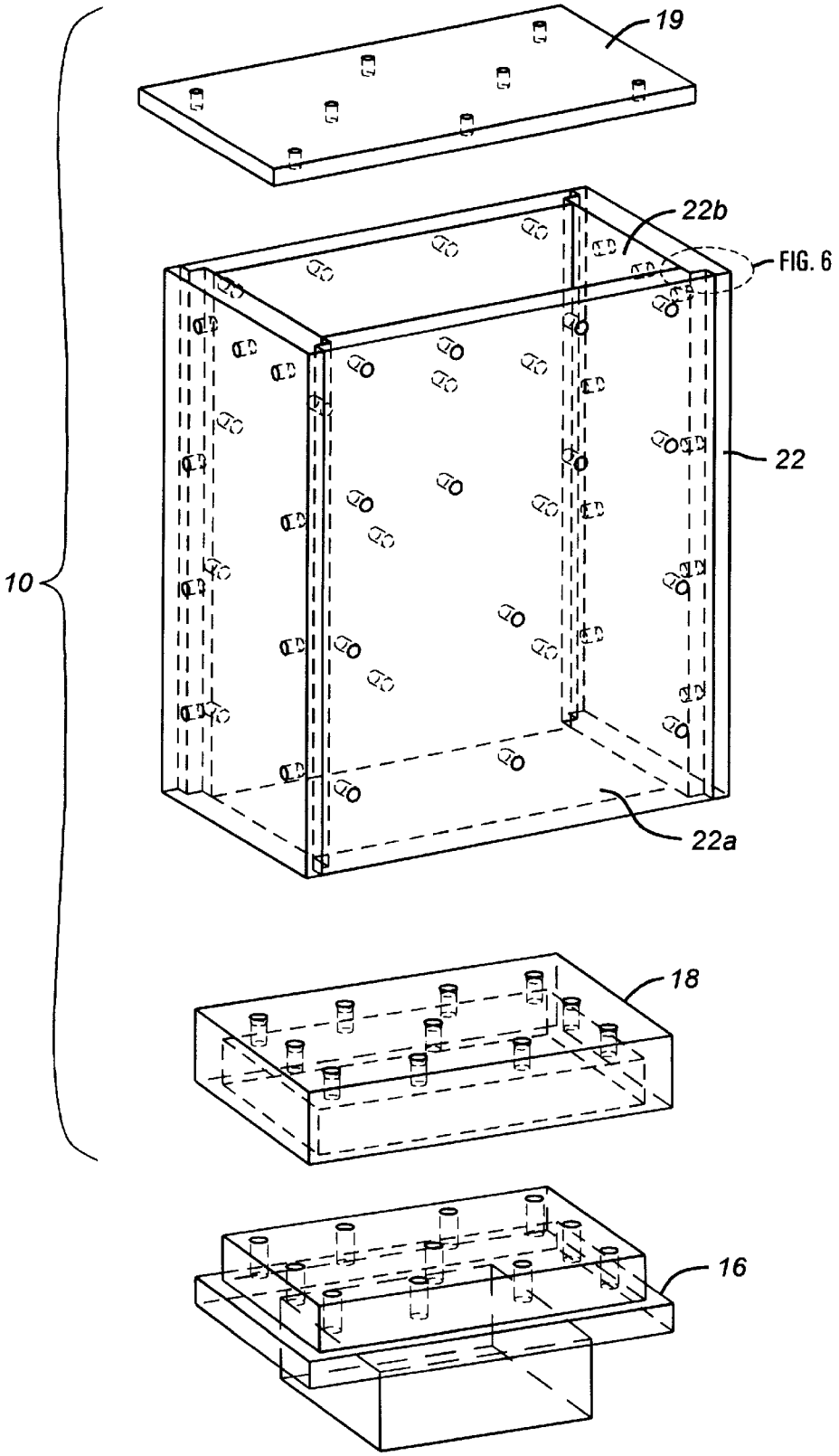
FIG. 4 is an exploded view of the press chamber components according to the resent invention.
Figure 5A:
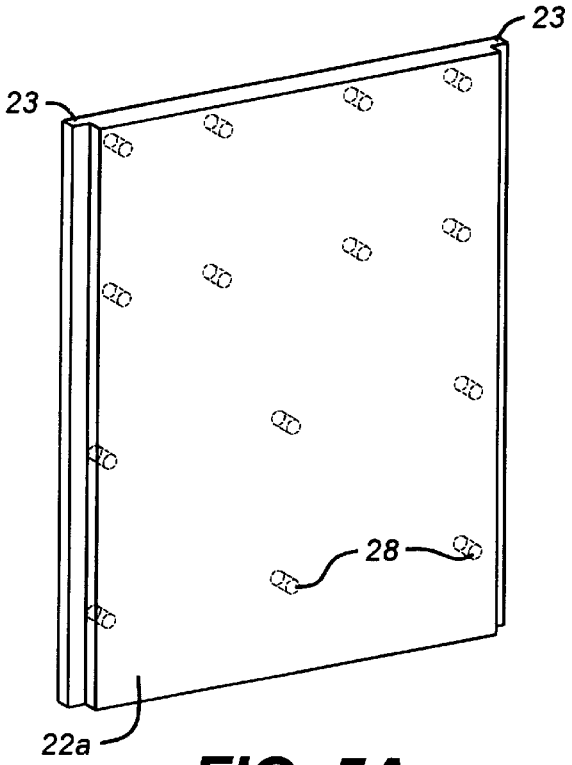
FIGS. 5A–5D are isometric views of press wall liners according to the invention.
Figure 5B:
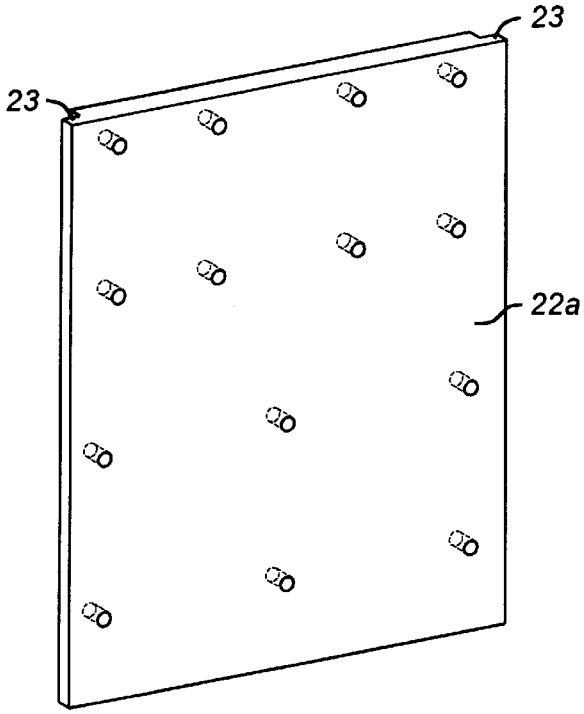
Figure 5C:
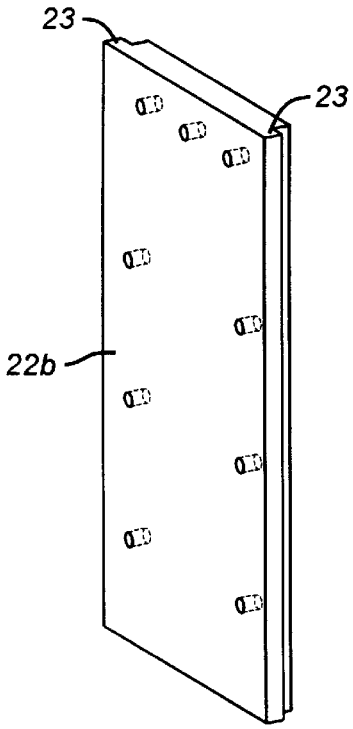
Figure 5D:
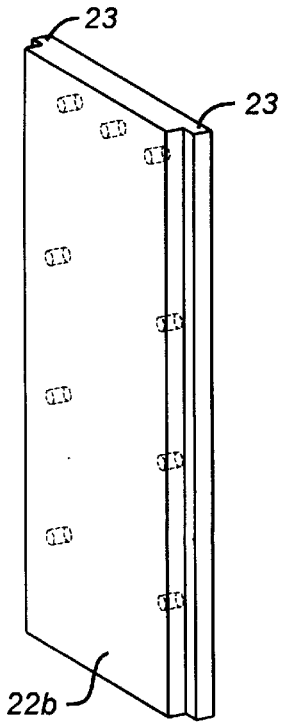

FIG. 4 depicts the components of the press chamber 10 in greater detail. Four thermoplastic polymer press wall liners 22 interlock to form the sides of the press chamber 10. The press wall liners are fixedly secured to the press walls 20 of FIG. 1. In the disclosed embodiment, two press wall liners 22*a* are somewhat longer that the other two press wall liners 22*b*, such that a rectangular press chamber 10 is formed. The precise shape of the press chamber 10 is not critical to the invention, however, and all four press wall liners 22 could be of equal dimensions, thereby forming a square press chamber 10. During a baling operation, the top of the press chamber 10 is formed by a press chamber top liner 19, which is also comprised of thermoplastic polymer in the preferred embodiment of the invention. The bottom of the press chamber is formed by the thermoplastic polymer ram head cover 18, which is affixed to the ram head 16.

Of import to the present invention, ram head cover 18 prevents the metal of the ram head 16 from coming into contact with the press wall liners 22. Although the press wall liners 22 by themselves provide improved performance over the prior art by preventing scoring of the press walls 20, the inclusion of the ram head cover 18 further extends the service life of the baler press assembly B by reducing wear on the press wall liners 22. The low static and dynamic coefficients of friction of the thermoplastic polymer material also reduce the hydraulic pressure necessary for the baling process. Through lengthy experimentation, it has been determined that a baler press assembly B according to the present invention has a very long service life as compared to prior baler press assemblies. In addition, reduced-friction interaction between the various press chamber 10 components ameliorates contamination of the rubber (or any other compressible material) by preventing the introduction of metal cuttings due to wear.

Turning now to FIGS. 5A–5D, isometric views of the press wall liners 22*a* and 22*b* are shown. Each of the press wall liners 22*a* and 22*b* include a plurality of liner bores 28 for receiving socket cap screws (not shown). The socket cap screws function to secure the press wall liners 22*a* and 22*b* to the press walls 20. Many other types of securing means, such as rivets, could be used to secure the press wall liners 22*a* and 22*b* to the press walls 20.

Figure 6:
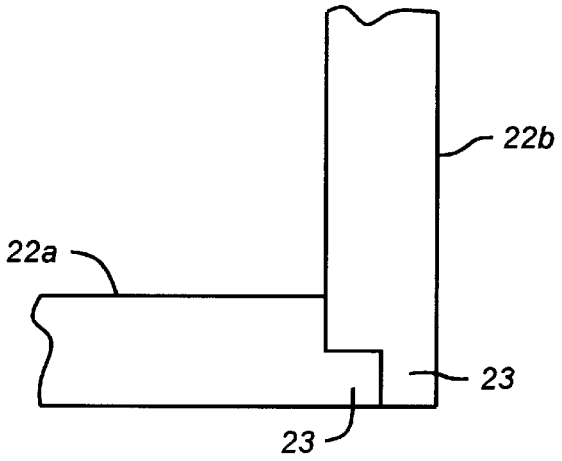
FIG. 6 is an isometric view of an interlocking press wall liner junction in accordance with the invention.

In addition to the liner bores 28, each of the press wall liners 22*a* and 22*b* of the disclosed embodiment also include extruded portions 23 for forming an interlocking junction between the press wall liners 22*a* and 22*b*. Turning briefly to FIG. 6, a top view of an interlocking press wall liner 22 junction is shown. In the disclosed embodiment, the extruded portions 23 of a press wall liner 22 are essentially lips formed by chamfering each end of the press wall liner 22. When the press wall liners 22 are installed in the press chamber 10, the extruded portions 23 are configured to interlock in a substantially congruent manner, such that migration of the compressible material between the press walls liners 22 is retarded. This feature of the invention further improves the service life of the baler press assembly B.

Referring now to FIGS. 7 and 8, a perspective view and a cross-sectional view, respectively, of the thermoplastic polymer ram head cover 18 according to the present invention are shown. As can be seen, the disclosed ram head cover 18 includes a recessed portion 18*a* that is configured to receive the reduced section 16*c* of the ram head 16. In addition, the ram head cover 18 includes a plurality of countersunk bores 34 corresponding to the bores of the reduced section of the ram head 16. Again, the precise manner in which the ram head cover 18 is affixed to the ram head 16 is not considered critical to the invention. As mentioned, all frictional contact between the ram assembly 12 and the press chamber 10 preferably occurs between the press wall liners 22 and the ram head cover 18.

It is contemplated that the novel portions of the baler press assembly 10 could be used in any type of press assembly having a press chamber. Further, the scope of the invention is not considered limited to rubber balers, but instead could be used in the compression of a wide variety of materials.

Thus, an improved service life baler press assembly including a number of novel press chamber and ram assembly components has been described. The press chamber and ram assembly components are formed of a material having a low coefficients of friction. In addition to extending the service life of the baler press assembly, the reduction in frictional wear interaction between the various components reduces product contamination due to metal cuttings.

The foregoing disclosure and description of the invention are illustrative and explanatory thereof, and various changes in the size, shape, materials, components, circuit elements, wiring connections and contacts, as well as in the details of the illustrated circuitry and construction and method of operation may be made without departing from the spirit of the invention.

What is claimed is:

1. A baling apparatus for compressing a compressible material, the baling apparatus comprising:

a ram assembly having a ram head;

a plurality of press walls forming a press chamber for receiving the ram head and the compressible material, wherein compression force is provided by movement of the ram head inside the press chamber; and a plurality of press wall liners coupled to the press walls and disposed between the press walls and the ram head during periods of compression, wherein the plurality of press wall liners are comprised of a material having low static and dynamic coefficients of friction, a first one of the plurality of press wall liners having a side surface with a first extruding portion of less thickness than the general thickness of the press wall liner, a second one of the plurality of press wall liners having a side surface with a second extruding portion of less thickness than the general thickness of the press wall liner, the first and second extruding portions adapted to tightly engage such that migration of the compressible material between the plurality of press wall liners is retarded.

2. The baling apparatus of claim 1, wherein the material having low static and dynamic coefficients of friction is a thermoplastic polymer material.

3. The baling apparatus of claim 1, wherein each of the plurality of press wall liners is integral with one of the plurality of press walls.

4. The baling apparatus of claim 1, wherein the first and second extruding portions are lips formed by chamfering an end of the first and second press wall liners, the lips being capable of interlocking in a substantially congruent manner.

5. The baling of claim 4, wherein the chamfering is at essentially right angles.

6. The baling apparatus of claim 1, further comprising:

wear strips disposed along the outer periphery of the ram head for engaging the press wall liners, the wear strips being comprised of a material having low static and dynamic coefficients of friction.

7. The bailing apparatus of claim 6, wherein the material forming the wear strips and having low static and dynamic coefficients of friction is a thermoplastic polymer material.

8. The baling apparatus of claim 1, wherein the compressible material is a rubber bale.

9. A baling apparatus for compressing a compressible material, the baling apparatus comprising:

a ram assembly, comprising:

a metallic ram head; and a ram head cover mounted on the ram head;

a plurality of press walls forming a press chamber for receiving the ram head assembly and the compressible material, wherein compression force is provided by movement of the ram head assembly inside the press chamber; and a plurality of press wall liners coupled to the press walls and disposed between the press walls and the ram head during periods of compression, a first one of the plurality of press wall liners having a side surface with a first extruding portion of less thickness than the general thickness of the press wall liner, a second one of the plurality of press wall liners having a side surface with a second extruding portion of less thickness than the general thickness of the press wall liner, the first and second extruding portions adapted to tightly engage such that migration of the compressible material between the plurality of press wall liners is retarded, wherein the plurality of press wall liners and the ram head cover are comprised of a material having low static and dynamic coefficients of friction.

10. The baling apparatus of claim 9, wherein the material having low static and dynamic coefficients of friction is a thermoplastic polymer material.

11. The baling apparatus of claim 9, wherein the ram head has a reduced surface area for receiving the ram head cover, and wherein the ram head cover prevents metal portions of the ram head from contacting the plurality of press wall liners.

12. The baling apparatus of claim 9, wherein the ram head cover is coupled to the ram head via bolting means.

13. The baling apparatus of claim 9, wherein each of the plurality of press wall liners is integral with one of the plurality of press walls.

14. The baling apparatus of claim 9, wherein the first and second extruding portions are lips formed by chamfering an end of the first and second press wall liners, the lips being capable of interlocking in a substantially congruent manner.

15. The baling apparatus of claim 14, wherein the chamfering is at essentially right angles.

16. The baling apparatus of claim 9, wherein the compressible material is a rubber bale.

17. A baling apparatus for compressing a compressible material, comprising:

a ram assembly, comprising:

a metallic ram head; and a ram head cover mounted on the ram head, the ram head having a reduced surface area for receiving the ram head cover;

a plurality of press walls forming a press chamber for receiving the ram head assembly and the compressible material, wherein compression force is provided by movement of the ram head assembly inside the press chamber; and a plurality of press wall liners coupled to the press walls and disposed between the press walls and the ram head during periods of compression, wherein the plurality of press wall liners and the ram head cover are comprised of a material having low static and dynamic coefficients of friction.

* * * * *